US012050042B2

(12) United States Patent
Kopko et al.

(10) Patent No.: US 12,050,042 B2
(45) Date of Patent: Jul. 30, 2024

(54) CONDENSER ARRANGEMENT FOR A CHILLER

(71) Applicant: Johnson Controls Tyco IP Holdings LLP, Milwaukee, WI (US)

(72) Inventors: William Leslie Kopko, Jacobus, PA (US); Icksoo Kyung, Clarksville, MD (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 280 days.

(21) Appl. No.: 17/434,346

(22) PCT Filed: Feb. 27, 2020

(86) PCT No.: PCT/US2020/020179
§ 371 (c)(1),
(2) Date: Aug. 26, 2021

(87) PCT Pub. No.: WO2020/176780
PCT Pub. Date: Sep. 3, 2020

(65) Prior Publication Data

US 2022/0128274 A1 Apr. 28, 2022

Related U.S. Application Data

(60) Provisional application No. 62/811,239, filed on Feb. 27, 2019.

(51) Int. Cl.
*F25B 6/02* (2006.01)
*F25B 39/00* (2006.01)
*F25B 39/04* (2006.01)

(52) U.S. Cl.
CPC ..... *F25B 6/02* (2013.01); *F25B 39/00* (2013.01); *F25B 39/04* (2013.01); *F25B 2339/047* (2013.01); *F25B 2400/06* (2013.01)

(58) Field of Classification Search
CPC .. F25B 6/02; F25B 39/00; F25B 39/04; F25B 40/02; F25B 2339/047; F25B 2400/06; F25B 2400/0417
See application file for complete search history.

(56) References Cited

U.S. PATENT DOCUMENTS

| | | | |
|---|---|---|---|
| 9,212,836 | B2 | 12/2015 | Welch |
| 9,618,214 | B2 | 4/2017 | Marte |
| 2009/0056348 | A1 | 3/2009 | Noll et al. |

FOREIGN PATENT DOCUMENTS

| | | | |
|---|---|---|---|
| CN | 101256042 | A | 9/2008 |
| CN | 105222337 | A | 1/2016 |

(Continued)

OTHER PUBLICATIONS

Chinese Office Action for CN Application No. 202080019941.3, dated Aug. 2, 2022, 9 pages.

(Continued)

*Primary Examiner* — Jonathan Bradford
(74) *Attorney, Agent, or Firm* — Fletcher Yoder, P.C.

(57) ABSTRACT

A heating, ventilation, air conditioning, and/or refrigeration (HVAC&R) system includes a first condenser configured to place a first refrigerant in a heat exchange relationship with a cooling fluid, a second condenser configured to place a second refrigerant in a heat exchange relationship with the cooling fluid, and a conduit system configured to direct a first portion of the cooling fluid from a cooling fluid supply to the first condenser and then through a first section of the second condenser in a series configuration. Further, the conduit system is configured to direct a second portion of the cooling fluid directly from the cooling fluid supply to a second section of the second condenser, such that the first portion of the cooling fluid and the second portion of the (Continued)

cooling fluid flow through the first condenser and the second condenser in a parallel configuration.

20 Claims, 11 Drawing Sheets

(56) References Cited

FOREIGN PATENT DOCUMENTS

| | | | |
|---|---|---|---|
| CN | 108369043 | A | 8/2018 |
| JP | 2016031174 | A | 3/2016 |
| KR | 101065549 | B1 | 5/2011 |
| WO | 2008045040 | A2 | 4/2008 |
| WO | 2011008375 | A1 | 1/2011 |

OTHER PUBLICATIONS

Korean Office Action for KR Application No. 10-2021-7030823, dated Aug. 17, 2022, 6 pages.
International Search Report and Written Opinion for PCT Application No. PCT/US2020/020179, mailed Aug. 6, 2020, 20 pgs.
Chinese Office Action for CN Application No. 202080019941.3, dated Oct. 30, 2023, 9 pages.

CONDENSER ARRANGEMENT FOR A CHILLER

CROSS REFERENCE TO RELATED APPLICATION

This application is a U.S. National Stage Application of PCT International Application No. PCT/US2020/020179, entitled "CONDENSER ARRANGEMENT FOR A CHILLER," filed Feb. 27, 2020, which claims priority to and the benefit of U.S. Provisional Application Ser. No. 62/811,239, entitled "CONDENSER ARRANGEMENT FOR A CHILLER," filed Feb. 27, 2019, each of which is hereby incorporated by reference in its entirety for all purposes.

BACKGROUND

This disclosure relates generally to environmental control systems, and more particularly, to a conduit system for directing cooling fluid through an environmental control system having multiple vapor compression systems.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Chiller systems, or vapor compression systems, utilize a working fluid (e.g., a refrigerant) that changes phases between vapor, liquid, and combinations thereof, in response to exposure to different temperatures and pressures within components of the vapor compression system. The chiller system may place a working fluid in a heat exchange relationship with a conditioning fluid, and may deliver the conditioning fluid to conditioning equipment and/or a conditioned environment of the chiller system. In some cases, a heating, ventilation, air conditioning, and/or refrigeration (HVAC&R) system may include multiple chiller systems, in which each chiller system includes a vapor compression system circulating a respective working fluid. The respective working fluid may remove heat from a flow of conditioning fluid that is in a heat exchange relationship with the respective working fluid via a component (e.g., an evaporator) of the chiller system. In such embodiments, each chiller system may also have a condenser configured to cool heated working fluid. For example, a cooling fluid may be directed through the respective condenser of each chiller system in a series arrangement to cool the respective working fluids. However, a flow arrangement of the cooling fluid through the condensers may limit an overall cooling capacity of the working fluid.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, air conditioning, and/or refrigeration (HVAC&R) system includes a first condenser configured to place a first refrigerant in a heat exchange relationship with a cooling fluid, a second condenser configured to place a second refrigerant in a heat exchange relationship with the cooling fluid, and a conduit system configured to direct a first portion of the cooling fluid from a cooling fluid supply to the first condenser and then through a first section of the second condenser in a series configuration. Further, the conduit system is configured to direct a second portion of the cooling fluid directly from the cooling fluid supply to a second section of the second condenser, such that the first portion of the cooling fluid and the second portion of the cooling fluid flow through the first condenser and the second condenser in a parallel configuration.

In another embodiment, a heating, ventilation, air conditioning, and refrigeration (HVAC&R) system includes a first condenser having a first condensing section and a first subcooler, in which the first condenser is configured to place a first refrigerant in a heat exchange relationship with a cooling fluid, and a second condenser having a second condensing section and a second subcooler, in which the second condenser is configured to place a second refrigerant in a heat exchange relationship with the cooling fluid. The HVAC&R system further includes a conduit system configured to direct a first portion of the cooling fluid from a cooling fluid supply to the first condenser and then through the second condensing section of the second condenser in a series arrangement, and to direct a second portion of the cooling fluid from the cooling fluid supply directly to the second subcooler of the second condenser, such that the first portion of the cooling fluid and the second portion of the cooling fluid flow through the first condenser and the second condenser in a parallel arrangement.

In another embodiment, a heating, ventilation, air conditioning, and refrigeration (HVAC&R) system includes a first condenser configured to place a first refrigerant in a heat exchange relationship with a cooling fluid, and a second condenser having a condensing section and a subcooler, in which the second condenser is configured to place a second refrigerant in a heat exchange relationship with the cooling fluid. The HVAC&R system further includes a valve configured to regulate a flow of a first portion of the cooling fluid from a cooling fluid supply to the first condenser and a flow of a second portion from the cooling fluid supply directly to the subcooler of the second condenser.

DRAWINGS

Various aspects of this disclosure may be better understood upon reading the following detailed description and upon reference to the drawings in which.

DETAILED DESCRIPTION

Figure 1:
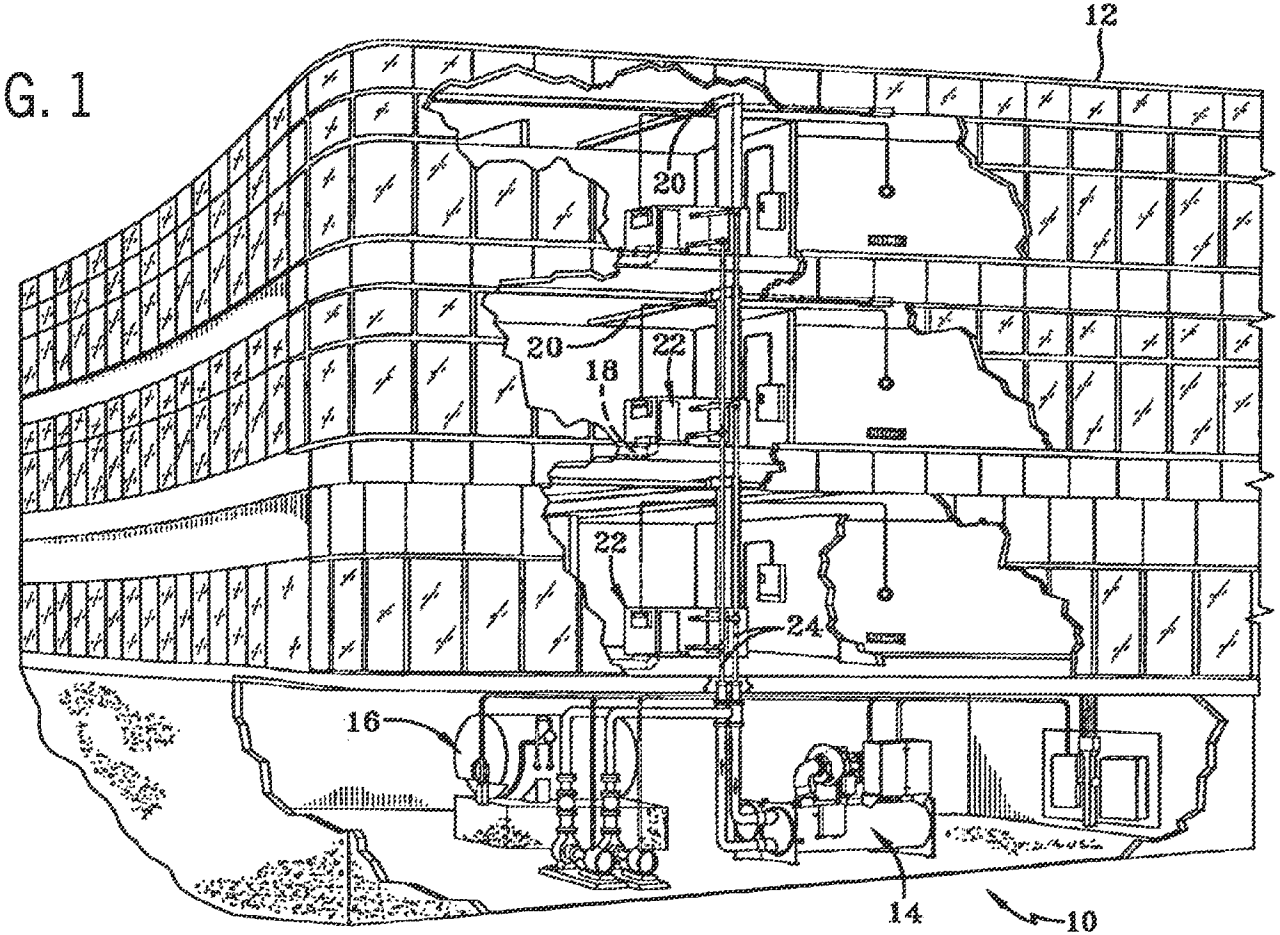
FIG. 1 is a perspective view of a building that may utilize an embodiment of a heating, ventilation, air conditioning, and/or refrigeration (HVAC&R) system in a commercial setting, in accordance with an aspect of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Embodiments of the present disclosure relate to an HVAC&R system having multiple vapor compression systems, in which a conditioning fluid is directed through respective heat exchangers (e.g., evaporators) of the vapor compression systems. Generally, implementing multiple vapor compression systems may increase a capacity of the HVAC&R system as compared to HVAC&R systems using a single vapor compression system. For instance, a conditioning fluid may be directed through, and cooled via, multiple heat exchangers (e.g., evaporators) instead of a single heat exchanger. That is, the conditioning fluid may be in thermal communication with a respective working fluid, such as a refrigerant, flowing through each of the heat exchangers (e.g., evaporators) of the respective vapor compression systems. Although this disclosure primarily describes refrigerant as the working fluids circulating through the vapor compression systems to exchange thermal energy with the conditioning fluid, additional or alternative embodiments may use other types of working fluids, such as water.

In accordance with embodiments of the present disclosure, an HVAC&R system may include multiple vapor compression systems that each include one or more heat exchangers. A cooling fluid may be directed through a respective heat exchanger of each vapor compression system to exchange thermal energy with a respective refrigerant of the vapor compression system. In some embodiments, cooling fluid may flow in a series arrangement through each respective heat exchanger of the multiple vapor compression systems. In other words, the cooling fluid may flow sequentially and directly from one heat exchanger (e.g., condenser) to another. In some cases, a direct series arrangement of the heat exchangers may limit a capacity of the cooling fluid to exchange thermal energy with the respective refrigerants of the multiple vapor compression systems. For example, the cooling fluid may enter a first condenser having a first subcooler and absorb thermal energy (e.g., heat) from a first refrigerant flowing through coils of the first condenser and the first subcooler, thereby heating, or increasing the temperature of, the cooling fluid. The heated cooling fluid may then be directed to a second condenser having a second subcooler to absorb thermal energy from a second refrigerant flowing through coils of the second condenser and the second subcooler. Since the heated cooling fluid absorbs heat from the first refrigerant, the heated cooling fluid may have a limited capacity to absorb heat from the second refrigerant within the second condenser and/or the second subcooler. As a result, the second refrigerant may not be sufficiently cooled by the cooling fluid, thus reducing an efficiency of the HVAC&R system.

Accordingly, it is now recognized that modifying the flow of the cooling fluid through the respective heat exchangers (e.g., condensers) and/or subcoolers of each vapor compression system may enhance or improve cooling capabilities of the cooling fluid. For example, instead of directing all of the cooling fluid in series through each heat exchanger and subcooler, a portion of supply cooling fluid may be directed to each subcooler of the multiple vapor compression systems concurrently (e.g., in parallel). As used herein, a series flow configuration refers to directing all or substantially all of a cooling fluid from a cooling fluid supply directly to a first heat exchanger and then from the first heat exchanger to a second heat exchanger. Additionally, as used herein, a parallel flow or partial parallel flow configuration refers to directing a portion of the cooling fluid from the cooling fluid supply directly to the first heat exchanger, and directing another portion of the cooling fluid from the cooling fluid supply directly to the second heat exchanger. As such, in the parallel or partial parallel flow configuration, at least a portion of each heat exchanger receives cooling fluid directly from the cooling fluid supply. In the parallel or partial parallel flow configuration, a greater overall amount of heat may be removed from the refrigerant in each of the vapor compression systems.

Turning now to the drawings, FIG. 1 is a perspective view of an embodiment of an environment for a heating, ventilation, and air conditioning (HVAC&R) system 10 in a building 12 for a typical commercial setting. The HVAC&R system 10 may include a vapor compression system 14 that supplies a chilled liquid, which may be used to cool the building 12. The HVAC&R system 10 may also include a boiler 16 to supply warm liquid to heat the building 12 and an air distribution system which circulates air through the building 12. The air distribution system can also include an air return duct 18, an air supply duct 20, and/or an air handler 22. In some embodiments, the air handler 22 may include a heat exchanger that is connected to the boiler 16 and the vapor compression system 14 by conduits 24. The heat exchanger in the air handler 22 may receive either heated liquid from the boiler 16 or chilled liquid from the vapor compression system 14, depending on the mode of operation of the HVAC&R system 10. The HVAC&R system 10 is shown with a separate air handler on each floor of building 12, but in other embodiments, the HVAC&R system 10 may include air handlers 22 and/or other components that may be shared between or among floors.

Figure 2:
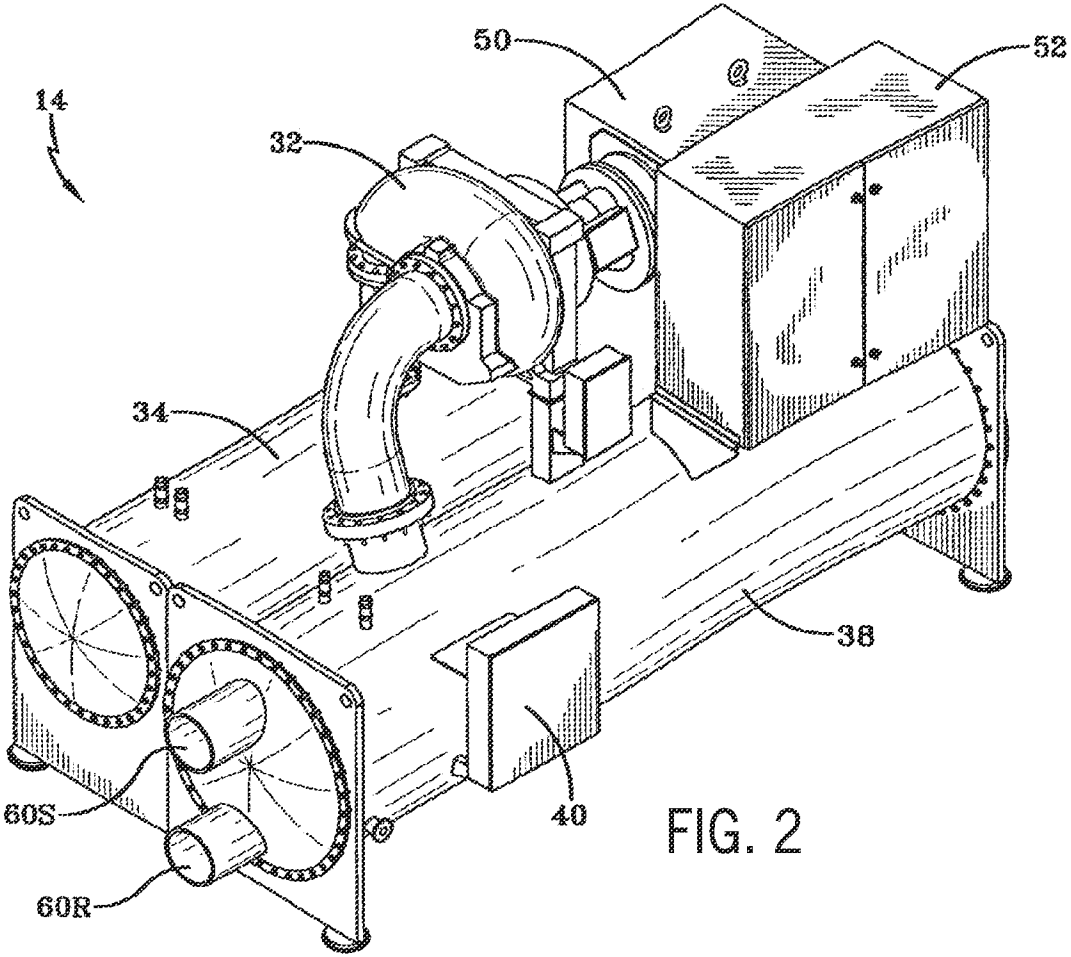
FIG. 2 is a perspective view of an embodiment of a vapor compression system, in accordance with an aspect of the present disclosure.
Figure 3:
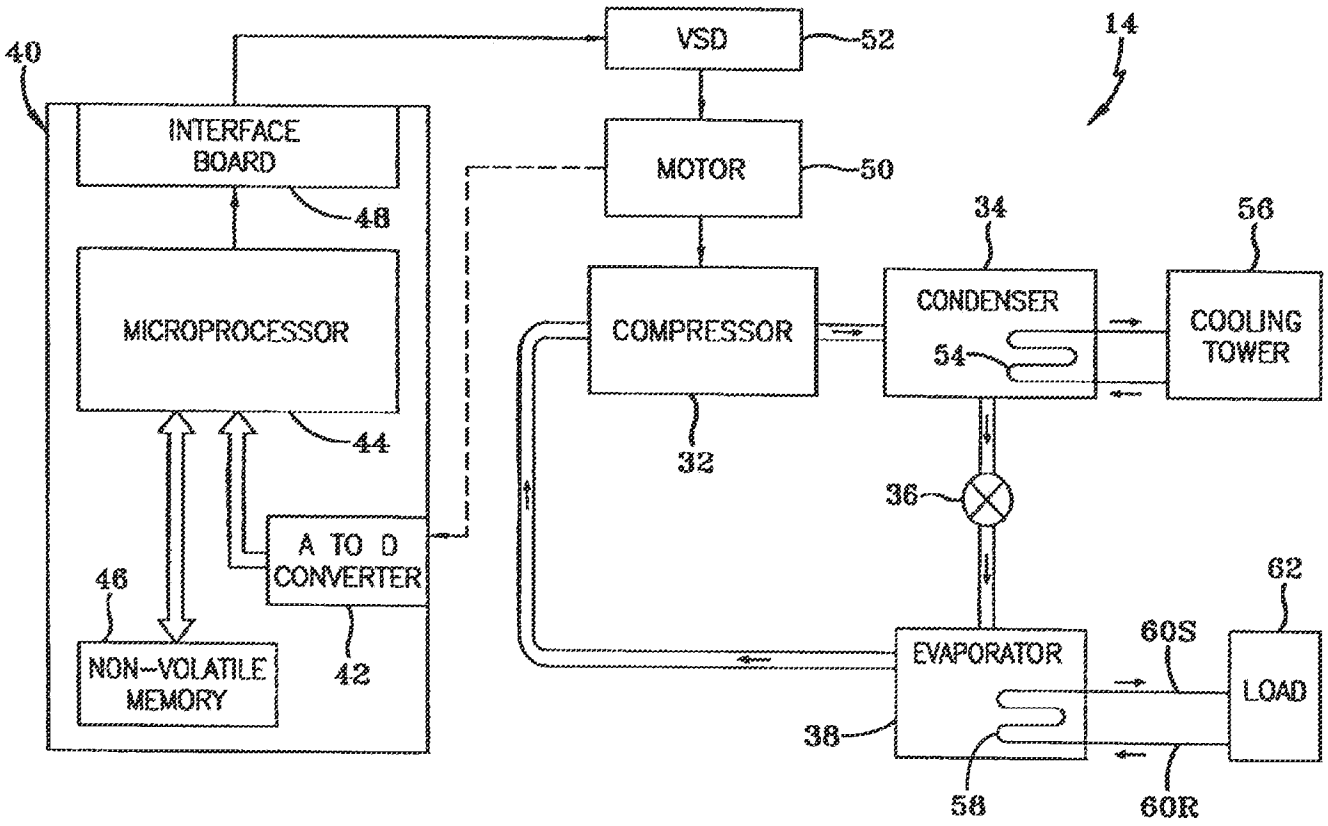
FIG. 3 is a schematic view of an embodiment of the vapor compression system of FIG. 2, in accordance with an aspect of the present disclosure.

FIGS. 2 and 3 are embodiments of the vapor compression system 14 that can be used in the HVAC&R system 10. The vapor compression system 14 may circulate a refrigerant through a circuit starting with a compressor 32. The circuit may also include a condenser 34, an expansion valve(s) or device(s) 36, and a liquid chiller or an evaporator 38. The vapor compression system 14 may further include a control panel 40 (e.g., controller) that has an analog to digital (A/D) converter 42, a microprocessor 44, a non-volatile memory 46, and/or an interface board 48.

Some examples of fluids that may be used as refrigerants in the vapor compression system 14 are hydrofluorocarbon (HFC) based refrigerants, for example, R-410A, R-407, R-134a, hydrofluoro-olefin (HFO), "natural" refrigerants like ammonia (NH3), R-717, carbon dioxide (CO2), R-744, or hydrocarbon based refrigerants, water vapor, refrigerants with low global warming potential (GWP), or any other suitable refrigerant. In some embodiments, the vapor compression system 14 may be configured to efficiently utilize refrigerants having a normal boiling point of about 19 degrees Celsius (66 degrees Fahrenheit or less) at one atmosphere of pressure, also referred to as low pressure refrigerants, versus a medium pressure refrigerant, such as R-134a. As used herein, "normal boiling point" may refer to a boiling point temperature measured at one atmosphere of pressure.

In some embodiments, the vapor compression system 14 may use one or more of a variable speed drive (VSDs) 52, a motor 50, the compressor 32, the condenser 34, the expansion valve or device 36, and/or the evaporator 38. The motor 50 may drive the compressor 32 and may be powered by a variable speed drive (VSD) 52. The VSD 52 receives alternating current (AC) power having a particular fixed line voltage and fixed line frequency from an AC power source, and provides power having a variable voltage and frequency to the motor 50. In other embodiments, the motor 50 may be powered directly from an AC or direct current (DC) power source. The motor 50 may include any type of electric motor that can be powered by a VSD or directly from an AC or DC power source, such as a switched reluctance motor, an induction motor, an electronically commutated permanent magnet motor, or another suitable motor.

The compressor 32 compresses a refrigerant vapor and delivers the vapor to the condenser 34 through a discharge passage. In some embodiments, the compressor 32 may be a centrifugal compressor. The refrigerant vapor delivered by the compressor 32 to the condenser 34 may transfer heat to a cooling fluid (e.g., water or air) in the condenser 34. The refrigerant vapor may condense to a refrigerant liquid in the condenser 34 as a result of thermal heat transfer with the cooling fluid. The refrigerant liquid from the condenser 34 may flow through the expansion device 36 to the evaporator 38. In the illustrated embodiment of FIG. 3, the condenser 34 is water cooled and includes a tube bundle 54 connected to a cooling tower 56, which supplies the cooling fluid to the condenser.

The refrigerant liquid delivered to the evaporator 38 may absorb heat from another cooling fluid, which may or may not be the same cooling fluid used in the condenser 34. The refrigerant liquid in the evaporator 38 may undergo a phase change from the refrigerant liquid to a refrigerant vapor. As shown in the illustrated embodiment of FIG. 3, the evaporator 38 may include a tube bundle 58 having a supply line 60S and a return line 60R connected to a cooling load 62. The cooling fluid of the evaporator 38 (e.g., water, ethylene glycol, calcium chloride brine, sodium chloride brine, or any other suitable fluid) enters the evaporator 38 via return line 60R and exits the evaporator 38 via supply line 60S. The evaporator 38 may reduce the temperature of the cooling fluid in the tube bundle 58 via thermal heat transfer with the refrigerant. The tube bundle 58 in the evaporator 38 can include a plurality of tubes and/or a plurality of tube bundles. In any case, the refrigerant vapor exits the evaporator 38 and returns to the compressor 32 by a suction line to complete the cycle.

Figure 4:
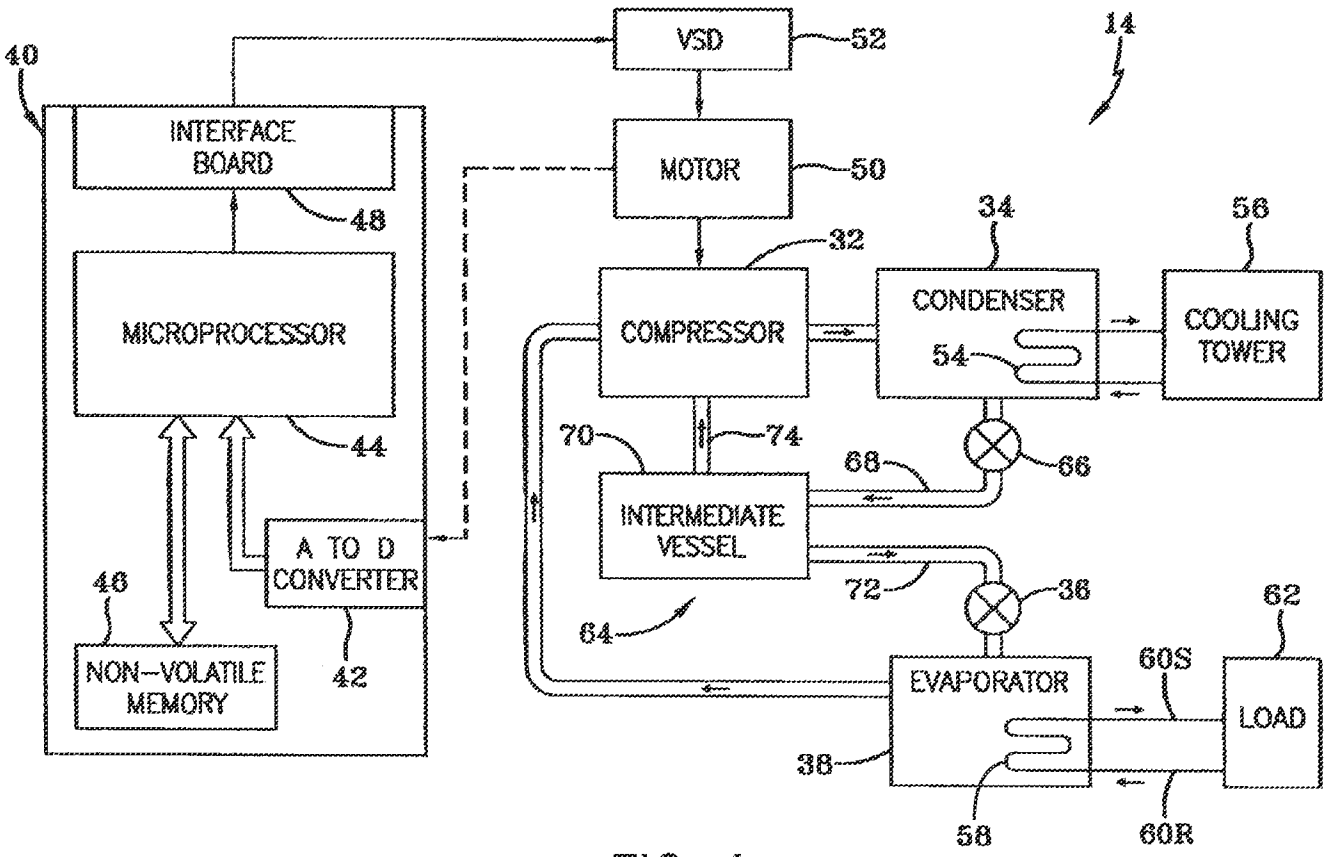
FIG. 4 is a schematic view of another embodiment of the vapor compression system of FIG. 2, in accordance with an aspect of the present disclosure.

FIG. 4 is a schematic view of the vapor compression system 14 with an intermediate circuit 64 incorporated between condenser 34 and the expansion device 36. The intermediate circuit 64 may have an inlet line 68 that is directly fluidly connected to the condenser 34. In other embodiments, the inlet line 68 may be indirectly fluidly coupled to the condenser 34. As shown in the illustrated embodiment of FIG. 4, the inlet line 68 includes a first expansion device 66 positioned upstream of an intermediate vessel 70. In some embodiments, the intermediate vessel 70 may be a flash tank (e.g., a flash intercooler). In other embodiments, the intermediate vessel 70 may be configured as a heat exchanger or a "surface economizer." In the illustrated embodiment of FIG. 4, the intermediate vessel 70 is used as a flash tank, and the first expansion device 66 is configured to lower the pressure of (e.g., expand) the refrigerant liquid received from the condenser 34. During the expansion process, a portion of the liquid may vaporize, and thus, the intermediate vessel 70 may be used to separate the vapor from the liquid received from the first expansion device 66. Additionally, the intermediate vessel 70 may provide for further expansion of the refrigerant liquid because of a pressure drop experienced by the refrigerant liquid when entering the intermediate vessel 70 (e.g., due to a rapid increase in volume experienced when entering the intermediate vessel 70). The vapor in the intermediate vessel 70 may be drawn by the compressor 32 through a suction line 74 of the compressor 32. In other embodiments, the vapor in the intermediate vessel may be drawn to an intermediate stage of the compressor 32 (e.g., not the suction stage). The liquid that collects in the intermediate vessel 70 may be at a lower enthalpy than the refrigerant liquid exiting the condenser 34 because of the expansion in the expansion device 66 and/or the intermediate vessel 70. The liquid from intermediate vessel 70 may then flow in line 72 through a second expansion device 36 to the evaporator 38.

In certain embodiments, an HVAC&R system may employ multiple vapor compression systems, such as a plurality of the vapor compression systems 14, to increase a capacity of the HVAC&R system. That is, a conditioning fluid (e.g., water or air) may be configured to flow through respective evaporators of each vapor compression system. In each evaporator, heat may be transferred from the conditioning fluid to the respective refrigerants of the vapor compression systems. Thus, the conditioning fluid transfers a greater amount of heat within multiple evaporators as compared to an HVAC&R system that includes a single evaporator. In HVAC&R systems employing multiple vapor compression systems, a cooling fluid may be configured to be directed through respective condensers of each vapor compression system in order to cool the respective refrigerants. However, the cooling capability of the cooling fluid may be limited when the cooling fluid flows directly from one condenser to another condenser. Further, the condensers of the vapor compression systems may include subcoolers. As such, an amount of thermal energy transferred to the cooling fluid within a subcooler downstream of another subcooler may be limited.

Figure 5:
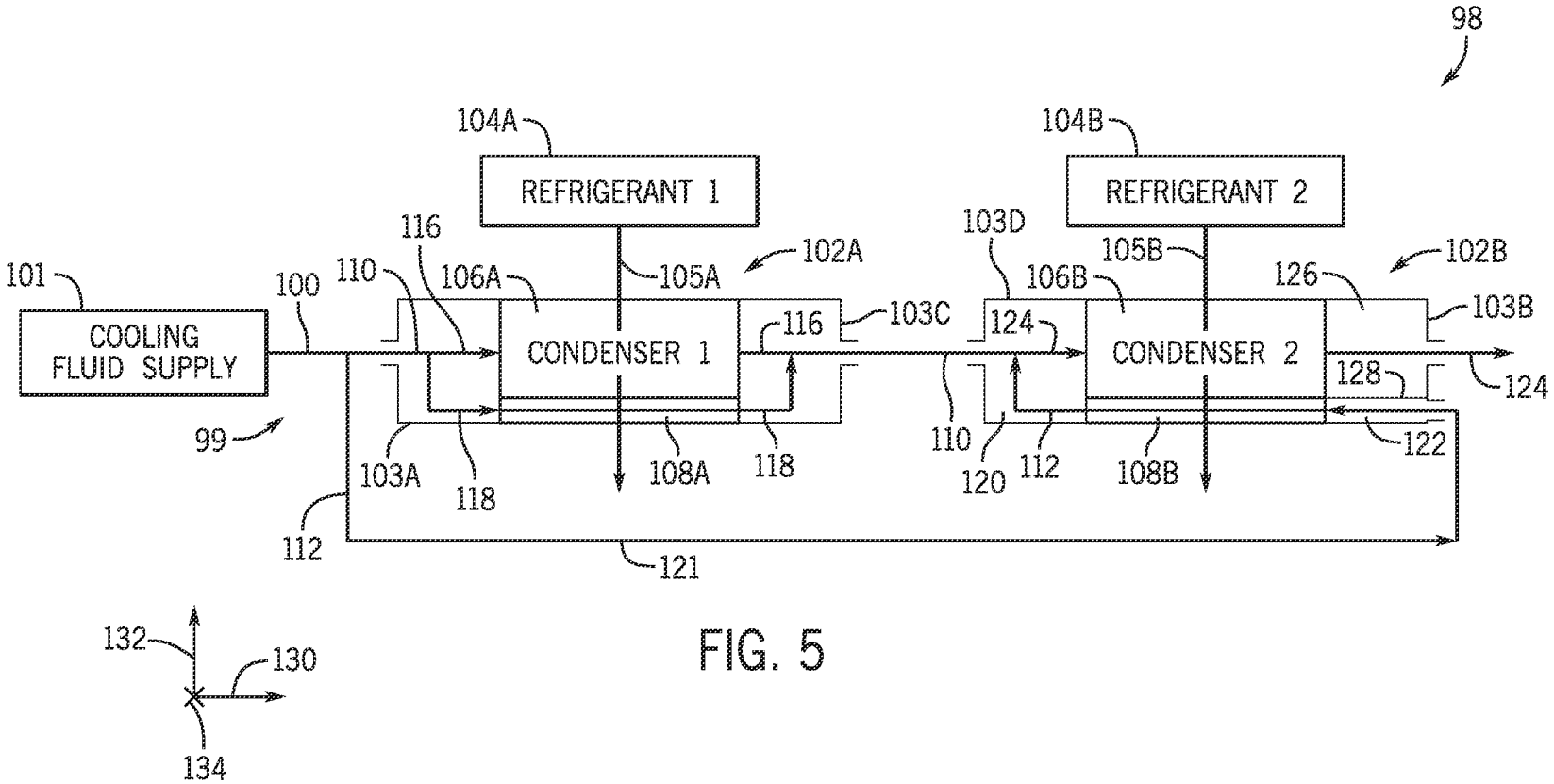
FIG. 5 is a schematic view of another embodiment of an HVAC&R system having a conduit system and two condensers of two chiller systems in a series arrangement with respect to a flow of a cooling fluid through the condensers, in accordance with an aspect of the present disclosure.

FIG. 5 is a schematic view of another embodiment of an HVAC&R system 98 having a conduit system 99 and two condensers in a series arrangement with respect to a flow of a cooling fluid 100 through the condensers. As used herein, the conduit system 99 includes any components, such as tubing, conduits, channels, flow paths, tube bundles (e.g., of the condensers), baffles, valves, waterboxes, and so forth, that enable the cooling fluid 100 to be directed through the HVAC&R system 98. In the illustrated embodiment, the conduit system 99 is configured to direct the cooling fluid 100 (e.g., water or air) from a cooling fluid supply 101 through a first condenser 102A of a first vapor compression system, and through a second condenser 102B of a second vapor compression system. The first condenser 102A may include a first waterbox 103A configured to receive the cooling fluid 100, and the second condenser 102A may include a second waterbox 103B that is at least partially configured to receive the cooling fluid 100. A first refrigerant 104A may be directed through the first condenser 102A (e.g., passed over tubes of the first condenser 102A) via a first conduit 105A, and a second refrigerant 104B may be directed through the second condenser 102B (e.g., passed over tubes of the second condenser 102B) via a second conduit 105B. In some embodiments, the first conduit 105A and the second conduit 105B are fluidly separate from one another. Thus, the first refrigerant 104A may circulate through a first refrigerant path of the first vapor compression system, and the second refrigerant 104B may circulate through a second refrigerant path of the second vapor compression system, where the first refrigerant path and the second refrigerant path are fluidly separate from one another. The cooling fluid 100 may be in thermal communication with both the first refrigerant 104A and the second refrigerant 104B via the first condenser 102A and the second condenser 102B, respectively.

In some embodiments, the first condenser 102A may have a first condensing section 106A and a first subcooler 108A, and the second condenser 102B may have a second condensing section 106B and a second subcooler 108B. The respective refrigerants 104 may be directed through the respective condensing sections 106 and then through the respective subcoolers 108. In each respective condenser 102, the cooling fluid 100 flowing through the condensing section 106 may remove an initial amount of heat from the respective refrigerant 104 flowing therethrough, and the cooling fluid 100 flowing through the respective subcooler 108 may remove an additional amount of heat from the respective refrigerant 104 to further cool the refrigerant 104. For example, both the condensing section 106 and the subcooler 108 may receive portions of the cooling fluid 100 in a parallel flow configuration. Accordingly, the refrigerant 104 in the condensing sections 106 may be reduced to a first temperature and the refrigerant 104 in the subcoolers 108 may be at a second temperature that is less than the first temperature.

In certain embodiments, the conduit system 99 may direct a first portion 110 of the cooling fluid 100 to the first condenser 102A and a second portion 112 of the cooling fluid 100 to the second condenser 102B (e.g., to the second subcooler 108B) directly from the cooling fluid supply 101. Thus, the cooling fluid 100 may be directed through the first condenser 102A and the second condenser 102B in a partial parallel flow arrangement. For example, the first portion 110 may be directed into the first waterbox 103A, where the first portion 110 may be further split into a third portion 116 and a fourth portion 118. In some embodiments, the third portion 116 of the cooling fluid 100 may be directed through the first condensing section 106A of the first condenser 102A, while the fourth portion 118 of the cooling fluid 100 may be directed through the first subcooler 108A of the first condenser 102A. Thus, in the first condenser 102A, heat may transfer from the first refrigerant 104A to the third portion 116 in the first condensing section 106A, thereby increasing a temperature of the third portion 116. Further, additional heat from the first refrigerant 104A may be transferred to the fourth portion 118 of the cooling fluid 100 in the first subcooler 108A to increase a temperature of the fourth portion 118. The heated third portion 116 and the heated fourth portion 118 of cooling fluid 100 may combine with one another in a third waterbox 103C of the first condenser 102A. Accordingly, the combined third portion 116 and fourth portion 118 of cooling fluid 100 (e.g., collectively the first portion 110 of the cooling fluid 100) may exit the first condenser 102A and flow toward a fourth waterbox 103D of the second condenser 102B.

The conduit system 99 may direct the second portion 112 of the cooling fluid 100 to bypass the first condenser 102A and flow through a conduit 121 toward the second waterbox 103B of the second condenser 102B. In certain embodiments, the conduit system 99 may direct the second portion 112 through a first section 122 of the second waterbox 103B and routed through the second subcooler 108B of the second condenser 102B. As such, the second portion 112 of the cooling fluid 100 may cool the second refrigerant 104B in parallel with the first portion 110 of the cooling fluid 100 flowing through the first condenser 102A (e.g., the first condensing section 106A and the first subcooler 108A). After flowing through the second subcooler 108B, the second portion 112 of the cooling fluid 100 may enter a third section 120 of the fourth waterbox 103D to combine with the first portion 110 of the cooling fluid 100 entering the fourth waterbox 103D from the first condenser 102A. A combined flow 124 of the first portion 110 and the second portion 112 of the cooling fluid may then flow through the second condensing section 106B of the second condenser 102B. In this manner, heat may transfer from the second refrigerant 104B to the combined flow 124 in the second condensing section 106B. Additional heat may be transferred from the second refrigerant 104B to the second portion 112 in the second subcooler 108B. Additionally, because the second portion 112 of the cooling fluid 100 has a relatively low temperature compared to the first portion 110 entering the fourth waterbox 103D, an increased amount of heat may be transferred from the second refrigerant 104B in the second subcooler 108B. In any case, after absorbing heat from the second refrigerant 104B, the combined flow 124 may exit the second condenser 102B via a second section 126 of the second waterbox 103B. As shown in FIG. 5, the second waterbox 103B may include a baffle 128 that separates the first section 122 and the second section 126, such that the second portion 112 flowing through the first section 122 is fluidly separate from the combined flow 124 flowing through the second section 126.

By virtue of the conduit system 99 arrangement described above, the temperature of the second portion 112 of the cooling fluid 100 in the first section 122 of the second waterbox 103B entering the second subcooler 108B may be approximately (e.g., within 10% of, within 5% of, or within 1% of) equal to the temperature of the third portion 116 and/or the fourth portion 118 entering the first condensing section 106A and the first subcooler 108A, respectively. In some embodiments, the temperature of the second portion 112, the third portion 116, and/or the fourth portion 118 of cooling fluid 100 may be between 32 degrees Celsius (° C.) and 35° C. (e.g., between 90 degrees Fahrenheit (° F.) and 95° F.). Moreover, the temperature of the second portion 112 entering the second subcooler 108B may be substantially less than the temperature of the combined flow 124 entering the second condenser 102B via the fourth waterbox 103D. For example, the temperature of the combined flow 124 in the fourth waterbox 103D may be between 37° C. and 39° C. (e.g., between 98° F. and 102° F.). Thus, directing the second portion 112 of the cooling fluid 100 to the second subcooler 108B may place the second refrigerant 104B in thermal communication with cooling fluid 100 from (e.g., directly from) the cooling fluid supply 101, which may have a greater cooling capacity and a reduced temperature when compared to the combined flow 124 previously heated by the first refrigerant 104A. In other words, a temperature of the second refrigerant 104B may be reduced by a greater amount when placed in thermal communication with the second portion 112 of the cooling fluid 100 in the second subcooler 108B as compared to being placed in thermal communication with the combined flow 124. For example, the second refrigerant 104B may be cooled to a temperature that is between 2° C. and 4° C. (e.g., between 3.5° F. and 7° F.) lower when the second portion 112 is directed through the second subcooler 108B when compared to directing the combined flow 124 through the second subcooler 108B.

Further still, in some embodiments, the temperature of the first portion 110 entering the fourth waterbox 103D may be greater than the temperature of the second portion 112 flowing into the fourth waterbox 103D from the second subcooler 108B. For instance, the temperature of the first portion 110 in the fourth waterbox 103D may be between 1° C. and 2° C. (e.g., between 1.5° F. and 4° F.) greater than the temperature of the second portion 112 exiting the second subcooler 108B. Thus, by mixing the first portion 110 with the second portion 112 in the fourth waterbox 103D to create the combined flow 124, the temperature of the combined flow 124 may also be reduced (e.g., between 0.25° C. and 1° C. or between 0.5° F. and 2° F.) when compared to the temperature of the first portion 110 initially entering the fourth waterbox 103D. As such, a greater amount of cooling may occur as a result of thermal communication between the second refrigerant 104B and the combined flow 124.

In FIG. 5, the condensers 102 may generally be positioned adjacent to one another along a longitudinal axis 130. That is, the condensers 102 are positioned in an end-to-end arrangement, such that axial or longitudinal ends of the condensers 102 are adjacent to one another. For this reason, the third portion 116 of the cooling fluid 100 may flow along a flow path extending substantially along the longitudinal axis 130 from the first condenser 102A to the second condenser 106B. Further, the conduit 121 may span an entirety of the combined lengths of the condensers 102 to direct the cooling fluid 100 from the cooling fluid supply 101 to the first section 122 of the second waterbox 103B. Moreover, the refrigerants 104 may flow in a direction transverse to the longitudinal axis 130, such as along a vertical axis 132 and/or along a lateral axis 134. In additional or alternative embodiments, the condensers 102 may be positioned relative to one another in any suitable manner, such as in a side-by-side arrangement (e.g., along the lateral axis 134), as further described below with respect to FIG. 13, along the vertical axis 132, and so forth.

Figure 6:
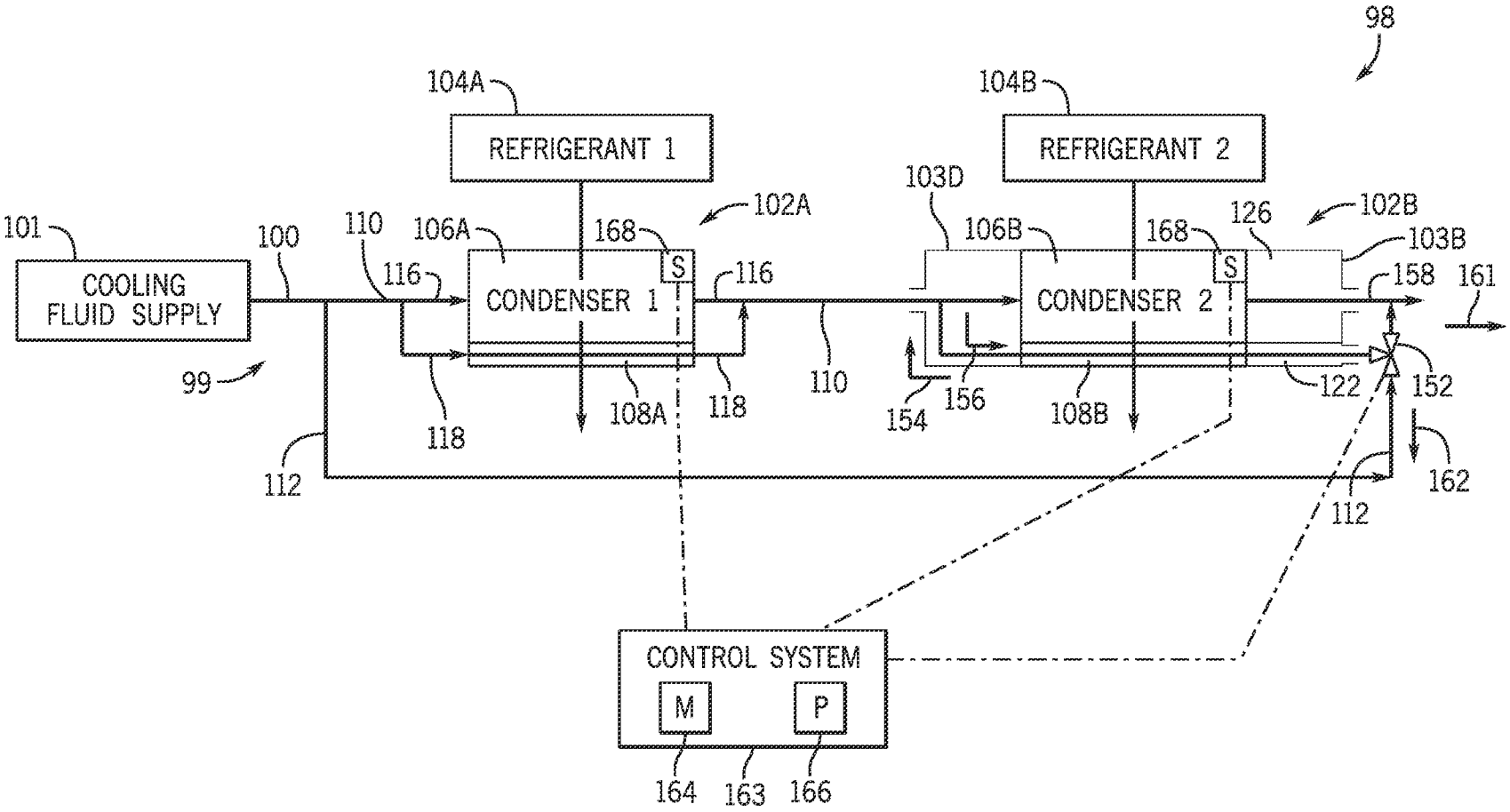
FIG. 6 is a schematic view of an embodiment of the HVAC&R system having valves to adjust a flow of the cooling fluid through the HVAC&R system, in accordance with an aspect of the present disclosure.

FIG. 6 is a schematic view of an embodiment of the HVAC&R system 98 having valves to adjust a flow of the cooling fluid 100 through the HVAC&R system 98. As illustrated in FIG. 6, the HVAC&R system 98 may include a valve 152 configured to connect the second subcooler 108B to either the second portion 112 or to the outlet flow 158. Although FIG. 6 illustrates the valve 152 as a three-way valve, the HVAC&R system 98 may include a different number of valves and/or valves having a different configuration that are configured to control a flow rate of the cooling fluid 100 through the HVAC&R system 98. The valve 152 may enable the HVAC&R system 98 to operate in the partial parallel flow arrangement as described in FIG. 5 or in a series flow arrangement.

As described herein, the partial parallel flow arrangement includes adjusting the valve 152 to split the cooling fluid 100 into the first portion 110 and the second portion 112, such as when both condensers 102 are in operation to cool the respective refrigerants 104. In the partial parallel flow arrangement, the valve 152 may be configured to enable the second portion 112 to flow through the second subcooler 108B in a first flow direction 154 into the fourth waterbox 103D to combine with the first portion 110 entering the fourth waterbox 103D. In some embodiments, the valve 152 may be adjusted to control the amount of cooling fluid 100 in each of the first and second portions 110, 112. For example, the first portion 110 and the second portion 112 may include the same amount of fluid (e.g., same flow rate of fluid), the first portion 110 may be greater than (e.g. twice the flow rate of) the second portion 112, or the first portion 110 may be less than (e.g., half the flow rate of) the second portion 112.

The HVAC&R system 98 may switch from the partial parallel flow arrangement to the series flow arrangement by adjusting the valve 152, such as when the operation of one of the condensers 102 is suspended or disabled (e.g., when the refrigerant 104 does not flow through one of the condensers 102). In the series flow operation, for example, the valve 152 may be adjusted to block the flow of the second portion 112 from the cooling fluid supply 101 toward the second subcooler 108B. Accordingly, the conduit system 99 directs substantially all of the cooling fluid 100 toward the first condenser 102A and the first subcooler 108A to exchange heat with the first refrigerant 104A. Additionally, the fourth waterbox 103D, which is positioned downstream of the first condenser 102A relative to the flow of cooling fluid 100, may receive the cooling fluid 100 and split the flow of the cooling fluid 100 (e.g., the first portion 110 of the cooling fluid 100) through the second condensing section 106B and the second subcooler 108B in a second flow direction 156. In other words, in the series flow arrangement, the conduit system 99 does not direct the second portion 112 through the second subcooler 108B in the first flow direction 154 and/or into the fourth waterbox 103D directly from the cooling fluid supply 101, which may reduce a pressure drop of the cooling fluid 100 flowing through the condensers 102. The configuration of the valve 152 may also enable the cooling fluid 100 flowing from the second condensing section 106B and the second subcooler 108B to combine with one another in the second waterbox 102B into an outlet flow 158 that flows in a third flow direction 161. Moreover, the configuration of the valve 152 in the series flow arrangement blocks or restricts the flow of cooling fluid 100 in a fourth flow direction 162 back toward the fourth waterbox 103D and/or otherwise toward the first condenser 102A.

Alternatively, the valve 152 may be a two-way valve that is configured to transition between an open position and a closed position. For example, in the open position, the valve 152 may enable fluid flow from the cooling fluid supply 101 to the second subcooler 108B, such as when both condensers 102 are in operation (e.g., the first refrigerant 104A flows through the first condenser 102A and the second refrigerant 104B flows through the second condenser 102B). In the closed position, the valve 152 may block fluid flow from the cooling fluid supply 101 to the second subcooler 108B, such as when operation of one of the condensers 102 is disabled or suspended (e.g., refrigerant 104 does not flow through one of the condensers 102). In some cases, the position of the valve 152 may also be selected to direct the cooling fluid to flush and/or clean components (e.g., piping) of the conduit system 99 and enable the HVAC&R system 98 to operate more efficiently.

In some embodiments, the HVAC&R system 98 may include a control system 163 configured to operate the HVAC&R system 98 (e.g., the valve 152). For example, the control system 163 may include a memory 164 and a processor 166. The memory 164 may be a mass storage device, a flash memory device, removable memory, or any other non-transitory computer-readable medium that includes instructions for controlling of the HVAC&R system 98. The memory 164 may also include volatile memory, such as randomly accessible memory (RAM) and/or non-volatile memory, such as hard disc memory, flash memory, and/or other suitable memory formats. The processor 166 may execute the instructions stored in the memory 164, such as instructions to adjust the valve 152 of the HVAC&R system 98.

For example, the control system 163 may be configured to adjust a position of the valve 152. In some embodiments, the control system 163 may be communicatively coupled to sensors 168, which may be configured to provide feedback indicative of an operating parameter within the condensers 102, such as a temperature of the refrigerant 104 and/or the cooling fluid 100, a flow rate of the refrigerant 104 and/or the cooling fluid 100, another suitable operating parameter, or any combination thereof. Based on the operating parameter(s), the control system 163 may be configured to adjust the respective position of the valve 152 to transition the HVAC&R system 98 between the partial parallel flow arrangement and the series flow arrangement.

Figure 7:
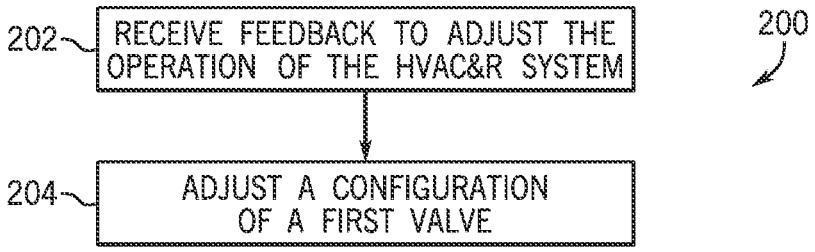
FIG. 7 is a block diagram of an embodiment of a method for adjusting operation of the HVAC&R system, in accordance with an aspect of the present disclosure.

FIG. 7 is a block diagram illustrating an embodiment of a method 200 for adjusting operation of the HVAC&R system 98 (e.g., between the partial parallel flow arrangement and the series flow arrangement). In certain embodiments, the method 200 may be performed by one or more controllers, such as the control system 163. In FIG. 7, the method 200 is described with reference to the embodiments of the HVAC&R systems 98 shown in FIGS. 5 and 6. However, a similar process or method may additionally or alternatively be performed in other embodiments of the HVAC&R system 98 that may have a different arrangement or configuration of valves. Furthermore, additional steps may be performed in addition to the method 200, or certain steps of the depicted method 200 may be modified, removed, or performed in a different order than shown in FIG. 7.

At block 202, the control system 163 may receive feedback from one or more of the sensors 168 to adjust the operation of the HVAC&R system 98. In some embodiments, the control system 163 may receive feedback indicative of an operating parameter value from the sensors 168 and compare the received feedback to a threshold value or a threshold range of values. In other embodiments, the feedback may be a user input transmitted by an operator in order to adjust the operation of the HVAC&R system 98. In such cases, the user input may be indicative of a manual adjustment between the series flow arrangement and the partial parallel flow arrangement. In further embodiments, the feedback may be indicative of another operating parameter, such as an operating status of the condensers 102.

At block 204, the control system 163 may adjust a position of the valve 152 based on the feedback. As described herein, the control system 163 may adjust a position of the valve 152 to enable the conduit system 99 to direct the first portion 110 of the cooling fluid 100 toward the first condenser 102A and the second portion 112 of the cooling fluid 100 toward the second subcooler 108B to operate the HVAC&R system 98 in the partial parallel flow arrangement. In some embodiments, the position of the valve 152 may be selected to adjust a flow rate of the second portion 112 of the cooling fluid 100 through the second subcooler 108B.

Alternatively, the control system 163 may adjust the position of the valve 152 to block the second portion 112 of the cooling fluid 100 from flowing from the cooling fluid supply 101 directly toward the second subcooler 108B in order to operate the HVAC&R system 98 in the series flow arrangement. For example, in the series flow arrangement, the valve 152 directs the cooling fluid 100 to flow directly from the cooling fluid supply 101 into the first condenser 102A, but not toward the second subcooler 108B. Further, the control system 163 may adjust the position of the valve 152 to permit flow of the cooling fluid 100 from the second subcooler 108B and through the second valve 152 to combine with the outlet flow 158. As such, the valve 152 may also block or restrict the flow of the cooling fluid 100 from the second subcooler 108B toward the cooling fluid supply 101 in the fourth flow direction 162 in the series flow arrangement.

In certain embodiments, additional steps may facilitate operational control of the HVAC&R system 98 (e.g., between the partial parallel flow arrangement and the series flow arrangement). For example, in either the series flow arrangement or the partial parallel flow arrangement, the control system 163 may be configured to adjust the position of the valve 152 to control the flow rate of the first portion 110 of the cooling fluid 100 directed through the first condensing section 106A and the first subcooler 108A. Additionally or alternatively, in the series flow arrangement, the control system 163 may be configured to adjust the position of the valve 152 to also control the flow rate of the cooling fluid 100 directed through the second condensing section 106B and the second subcooler 108B. Indeed, the position of the valve 152 may be selected to control an amount of cooling fluid in the first portion 110 and an amount of cooling fluid in the second portion 112 to be any suitable amounts or ratios of amounts.

Figure 8:
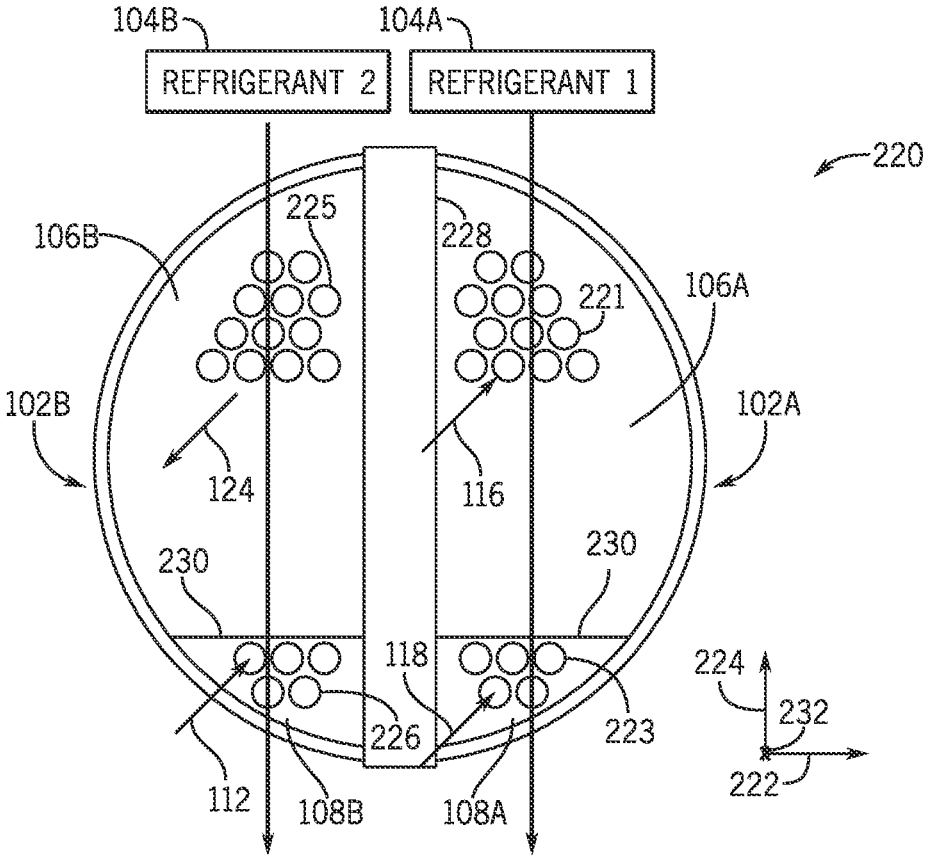
FIG. 8 is a cross-sectional view of an embodiment of a condenser shell that may be used by the HVAC&R system, in accordance with an aspect of the present disclosure.

FIG. 8 is a cross-sectional view of an embodiment of a shell 220 for the condensers 102 of the HVAC&R system 98. That is, the shell 220 may be configured to house or define both the first condenser 102A and the second condenser 102B. The shell 220 may be configured to direct the cooling fluid 100 through the first and second condensers 102 in the partial parallel flow arrangement and the series flow arrangement set forth above, such that the cooling fluid 100 is directed through the shell 220 in two passes. As illustrated in FIG. 8, the shell 220 may have a substantially circular cross-section, though in other embodiments, the shell 220 may have a cross-section shaped in any suitable geometry.

The shell 220 may include the first condenser 102A and the second condenser 102B positioned adjacent to one another relative to a lateral axis 222. The first condenser 102A may include the first condensing section 106A having a first tube bundle 221 positioned above the first subcooler 108A having a second tube bundle 223 with respect to a vertical axis 224. Moreover, the second condenser 102B may include the second condensing section 106B having a third tube bundle 225 positioned above the second subcooler 108B having a fourth tube bundle 226 with respect to the vertical axis 224. In this manner, the first refrigerant 104A may generally flow along the vertical axis 224 (e.g., downwardly) through the first condensing section 106A and the first subcooler 108A, while the second refrigerant 104B may generally flow along the vertical axis 224 (e.g., downwardly) through the second condensing section 106B and the second subcooler 108B. As refrigerant 104 comes into contact with the respective tube bundles 221, 223, 225, 226, heat exchange occurs between the respective refrigerants 104 and the cooling fluid 100.

In some embodiments, the shell 220 may include walls that fluidly separate the first condenser 102A and the second condenser 102B from one another. For example, the shell 220 may include a wall 228 (e.g., extending along the vertical axis 224) that separates the first refrigerant 104A flowing through the first condensing section 106A and/or the first subcooler 108B from the second refrigerant 104B flowing through the second condensing section 106B and/or the second subcooler 108B. Moreover, the condensing sections 106 and the subcoolers 108 may be separated by a perforated baffle 230 (e.g., extending along the lateral axis 222) that enables the refrigerant 104 to pass from the condensing sections 106 to the subcoolers 108. In other embodiments, the first tube bundle 221 and the second tube bundle 223 may be separated by a gap or space instead of the perforated baffle 230, and the third tube bundle 225 and the fourth tube bundle 226 may be separated by a gap or space instead of the perforated baffle 230. In some embodiments, the condensing sections 106 and the subcoolers 108 extend substantially parallel to one another along a length of the shell 220 (e.g., in a longitudinal direction 232). The cooling fluid 100 may be configured to flow through either the first condensing section 106A, the first subcooler 108A, and/or the second subcooler 108B (e.g., via the first waterbox 103A and/or the second waterbox 103B) in the longitudinal direction 232. Additionally, the cooling fluid 100 may be configured to flow through the second condensing section 106B in a direction opposite the longitudinal direction 232.

Figure 9:
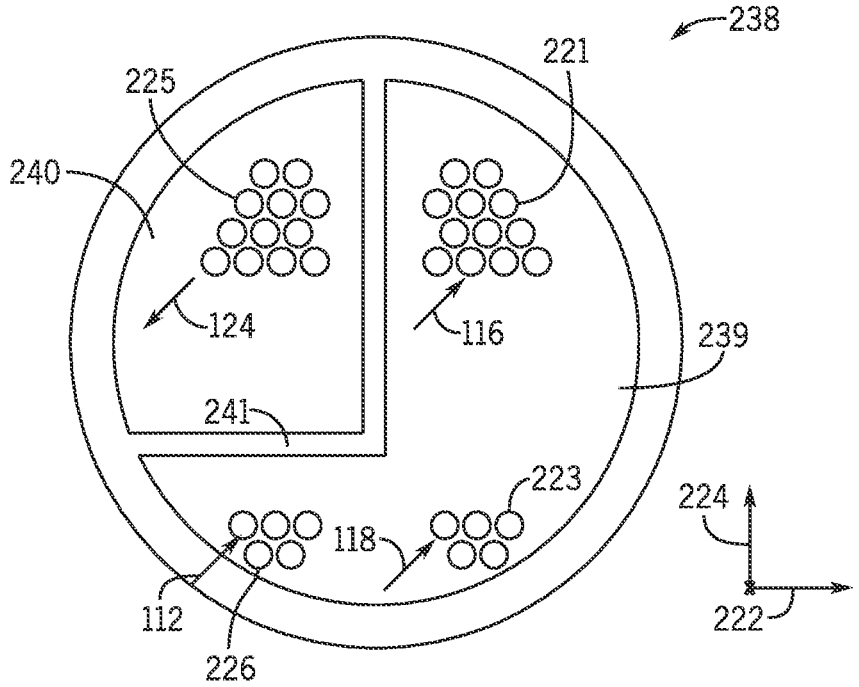
FIG. 9 is a front view of an embodiment of a tubesheet that may be disposed on an end of the condenser shell of FIG. 8, in accordance with an aspect of the present disclosure.

FIG. 9 is a front view of an embodiment of a first tubesheet 238 that may be disposed on a first end of the shell 220, such as an end that has fluid connections to enable the shell 220 to receive fluid (e.g., from the cooling fluid supply 101). For simplicity, fasteners for coupling the first tubesheet 238 to the shell 220 (e.g., to a waterbox of the shell 220) are not shown in FIG. 9. As used herein, a "tubesheet" may refer to a cap or end of the shell 220 that may couple the shell 220 to a waterbox. As such, the geometry of the first tubesheet 238 may match or conform to a geometry of the shell 220. The cooling fluid 100 may flow through a first section 239 of the shell 220 as a first pass. For example, the first tubesheet 238 may be fluidly coupled to the cooling fluid supply 101 configured to direct cooling fluid 100 to the first tube bundle 221, the second tube bundle 223, and the fourth tube bundle 226 as a first pass through the shell 220. Additionally or alternatively, the first tubesheet 238 may be coupled to the first waterbox 103A and the first section 122 of the second waterbox 103B to enable the cooling fluid 100 to flow through the first tube bundle 221 (e.g., the first condensing portion 106A), the second tube bundle 223 (e.g., the first subcooler 108A), and the fourth tube bundle 226 (e.g., the second subcooler 108B).

Moreover, cooling fluid 100 may be configured to flow through the shell 220 as a second pass via a second section 240. In other words, the cooling fluid 100 flowing through the first section 239 may be directed into the second section 240 via the fourth waterbox 103D, which combines the flow of the cooling fluid 100 from the first tube bundle 221, the second tube bundle 223, and the fourth tube bundle 226 and directs the flow of the cooling fluid into the third tube bundle 225. As such, the first section 239 may be fluidly separate from the second section 240, such as via a first gasket 241 place on top of the first tubesheet 238 (e.g., between the first tubesheet 238 and a separate waterbox). For example, the first gasket 241 may fit onto at least a portion of a perimeter of the first tubesheet 238 and may direct the cooling fluid 100 through the first tube bundle 221 of the first condensing section 106A, the second tube bundle 223 of the first subcooler 108A, and the fourth tube bundle 226 of the second subcooler 108B. Moreover, the first gasket 241 blocks the cooling fluid 100 in the first section 239 from flowing into the third tube bundle 225 of the second condensing section 106B. As illustrated in FIG. 9, the first gasket 241 may have an "L" shape that fluidly separates the first section 239 from the second section 240, but in other embodiments, the first gasket 241 may have any suitable shape to block fluid flow to the third tube bundle 225.

Figure 10:
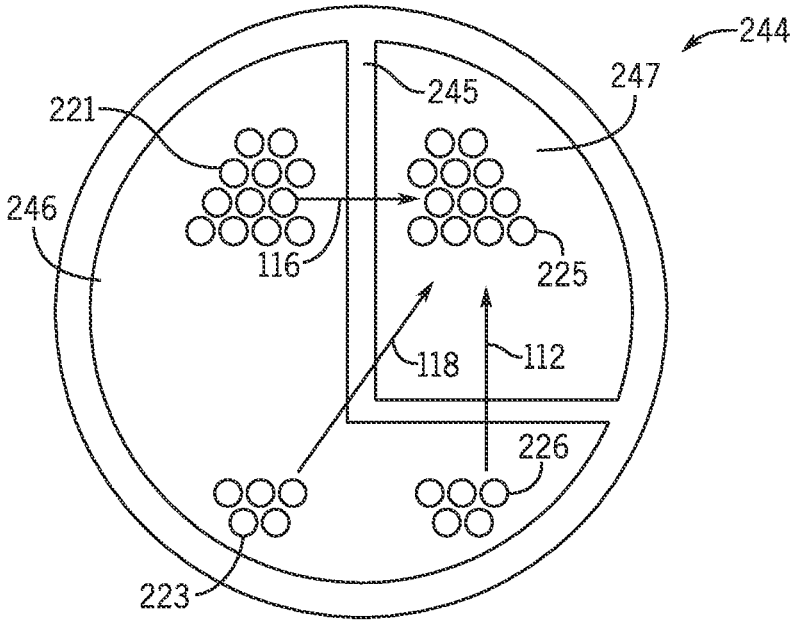
FIG. 10 is a front view of an embodiment of a tubesheet that may be disposed on an end of the condenser shell of FIG. 8, in accordance with an aspect of the present disclosure.

FIG. 10 is a front view of another embodiment of a second tubesheet 244 that may be disposed on a second end of the shell 220. The second end may be opposite the first end and fluid may flow between the first end and the second end. The second tubesheet 244 may facilitate a flow of the cooling fluid 100 from the first tube bundle 221, the second tube bundle 223, and the fourth tube bundle 226 toward the third tube bundle 225 via the fourth waterbox 103D, for example. That is, after the respective flows of the cooling fluid 100 are directed through the length of the shell 220 in a common direction, the third portion 116, the fourth portion 118, and the second portion 112 may mix with one another to form the combined flow 124 that is directed into the second condensing section 106B in an opposite direction. For example, the second tubesheet 244 includes a second gasket 245 that defines a third section 246 and a fourth section 247. The second gasket 245 may fit onto at least a portion of a perimeter of the second tubesheet 244 and may enable the second portion 112 of the cooling fluid 100 from the fourth tube bundle 226, the third portion 116 from the first tube bundle 221, and the fourth portion 118 from the second tube bundle 223 to be directed to the third tube bundle 225, such as via the fourth waterbox 103D. The second gasket 245 in the embodiment of FIG. 10 has an "L" shape that fluidly separates the third section 246 and the fourth section 247, but in other embodiments, the second gasket 245 may include any suitable geometry to promote the mixture of the second portion 112, the third portion 116, and the fourth portion 118 into the combined flow 124. The combined flow 124 may then be directed through the third tube bundle 225 to flow through the shell 220 in a second pass.

Figure 11:
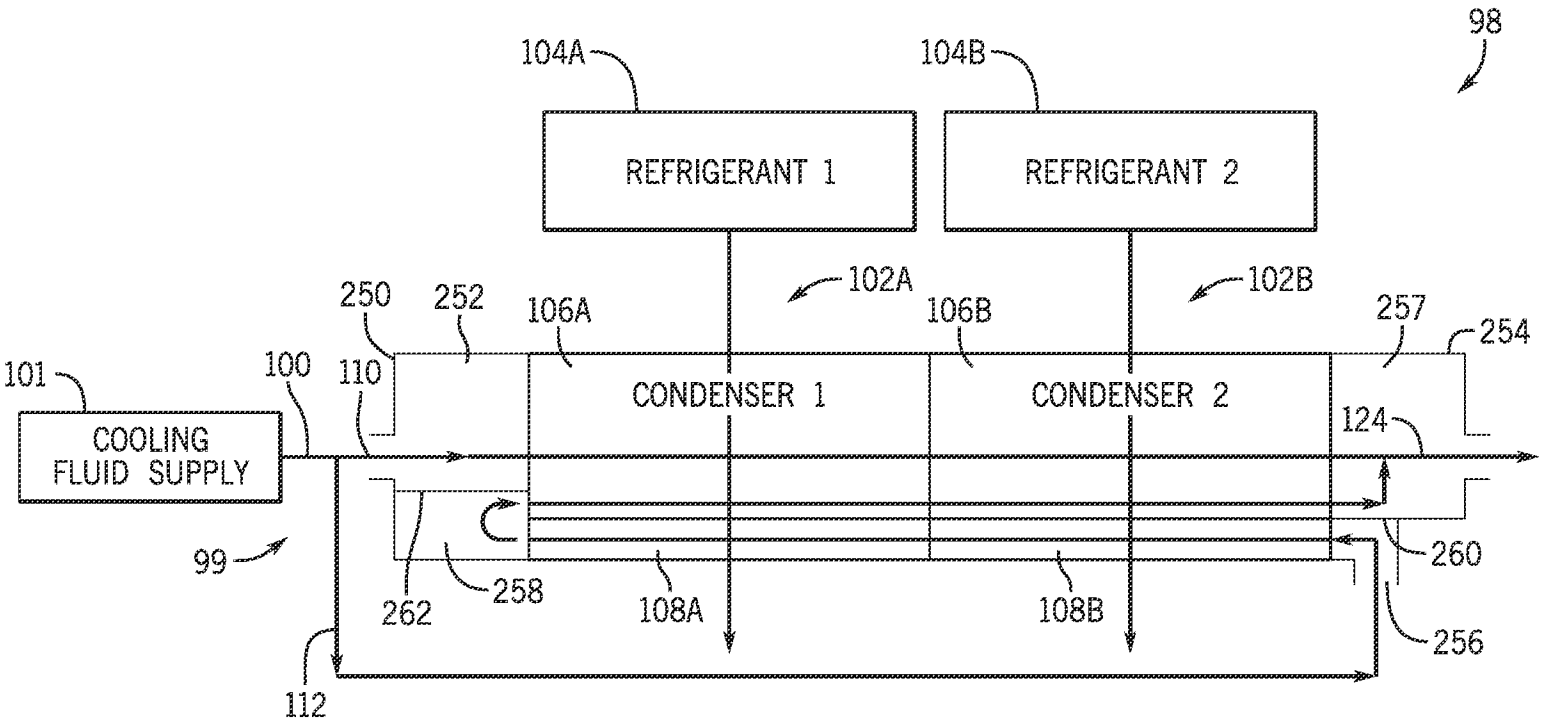
FIG. 11 is a schematic view of another embodiment of the HVAC&R system having two condensers of two chiller systems configured to operate in a partial parallel flow arrangement, in accordance with an aspect of the present disclosure.

FIG. 11 is a schematic view of another embodiment of the HVAC&R system 98 having two condensers 102 that may be configured to operate in the partial parallel flow arrangement. In the illustrated embodiment, the first condenser 102A and the second condenser 102B may share a first common waterbox 250 and/or share a common set of tubes (e.g., a common tube bundle). Accordingly, tubes may extend through both the first condensing section 106A of the first condenser 102A and the second condensing section 106B of the second condenser 102B. In the illustrated embodiment, the conduit system 99 directs the first portion 110 of the cooling fluid 100 through the first condensing section 106A of the first condenser 102A via a first section 252 of the first common waterbox 250. The conduit system 99 then directs the first portion 110 of the cooling fluid 100 through the second condensing section 106B of the second condenser 102B (e.g., via the shared tubes) and into a second common waterbox 254. Furthermore, the conduit system 99 directs the second portion 112 of the cooling fluid 100 from the cooling fluid supply 101 to the second subcooler 108B of the second condenser 102B via a first section 256 of the second common waterbox 254. The second portion 112 flows through the second subcooler 108B and then through the first subcooler 108A of the first condenser 102A (e.g., via another shared tube bundle). After flowing through the first subcooler 108A, the conduit system 99 directs the second portion 112 into a second section 258 of the first common waterbox 250. The first common waterbox 250 directs the second portion 112 of the cooling fluid 100 through tubes arranged in at least a portion of the first condensing section 106A and the second condensing section 106B. After flowing through the first condensing section 106 and the second condensing section 106B, the second portion 112 flows into a second section 257 of the second common waterbox 254, where the second portion 112 combines with the first portion 110 to form the combined flow 124 before exiting the second common waterbox 254.

As illustrated in FIG. 11, both the first portion 110 and the second portion 112 of the cooling fluid 100 flow through both condensers 102. The first portion 110 flows through the condensers 102 in a one-pass configuration, and the second portion 112 flows through the condensers 102 in a two-pass configuration (i.e., one pass via the subcoolers 108 and a second pass via at least a portion of the condensing sections 106). Accordingly, the first refrigerant 104A flowing through the first condenser 102A and the second refrigerant 104B flowing through the second condenser 102B may each be placed in thermal communication with a pass of the first portion 110 and two passes of the second portion 112. In some embodiments, the cooling efficiency of the HVAC&R system 98 of FIG. 11 may be increased by directing the first portion 110 and the second portion 112 through the condensers 102 in a partial parallel arrangement.

As shown in the illustrated embodiment of FIG. 11, the second common waterbox 254 may include a first baffle 260 configured to separate the first section 256 from the second section 257, such that the second portion 112 flowing toward the second subcooler 108B is fluidly separate from the first portion 110 and/or the combined flow 124 flowing through the second section 257. Furthermore, the first common waterbox 250 may include a second baffle 262 configured to separate the first section 252 from the second section 258, such that the second portion 112 flowing from the first subcooler 108A to at least a portion of the first condensing section 106A is fluidly separate from the first portion 110 flowing through the first section 252 toward the first condensing section 106A.

Figure 12:
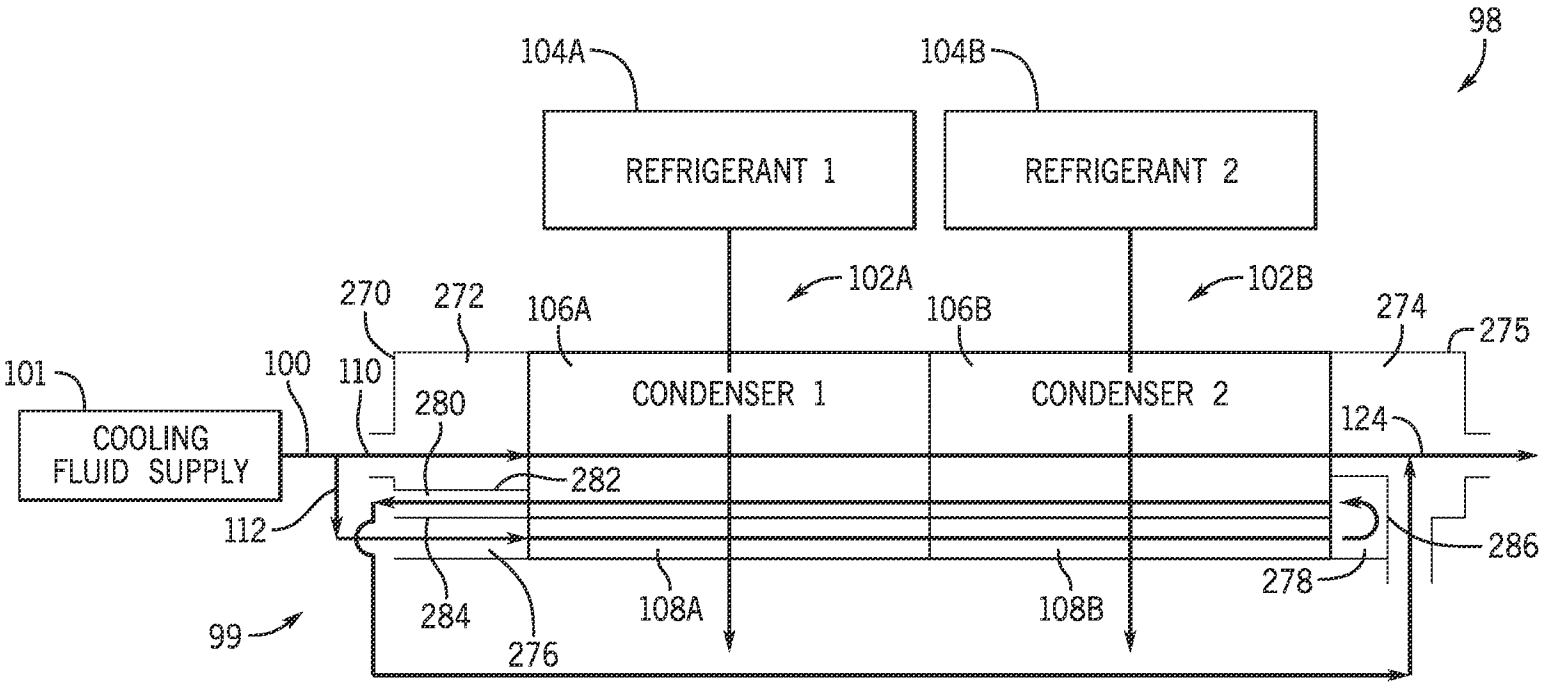
FIG. 12 is a schematic view of another embodiment of the HVAC&R system having two condensers of two chiller systems configured to operate in a series arrangement, in accordance with an aspect of the present disclosure.

FIG. 12 is a schematic view of an embodiment of the HVAC&R system 98 having two condensers 102 configured to operate in a series arrangement. In the illustrated embodiment of FIG. 12, the first condenser 102A and the second condenser 102B share a first common waterbox 270 and/or share a common set of tubes. In some embodiments, the first condenser 102A and the second condenser 102B of FIG. 12 may be connected together and share a common shell. As illustrated in FIG. 12, the conduit system 99 may direct the first portion 110 of the cooling fluid 100 into the first condensing section 106A of the first condenser 102A via a first section 272 of the first common waterbox 270. The conduit system 99 then directs the first portion 110 through the second condensing section 106B of the second condenser 102B (e.g., via the shared tubes) into a first section 274 of a second common waterbox 275. Meanwhile, the conduit system 99 may direct the second portion 112 through the first subcooler 108A via a second section 276 of the first common waterbox 270. The second portion 112 flows through the first subcooler 108A and then through the second subcooler 108B (e.g., via another shared tube bundle) in a series arrangement. After flowing through the second subcooler 108B, the second portion 112 may be directed into a second section 278 of the second common waterbox 275 to flow through at least a portion of the second condensing section 106B and then through the first condensing section 106A. After flowing through the first condensing section 106A, the conduit system 99 may direct the second portion 112 from a third section 280 of the first common waterbox 270 to the first section 274 of the second common waterbox 275. In the first section 274 of the second common waterbox 275, the second portion 112 may be combined with the first portion 110 into the combined flow 124 before exiting the second common waterbox 275.

The first common waterbox 270 may include a first baffle 282 configured to separate the first section 272 from the third section 280 and fluidly isolate the second portion 112 flowing out of the first condensing section 106A with the first portion 110 flowing into the first condensing section 106A. The first common waterbox 270 may also include a second baffle 284 configured to separate the second section 276 from the third section 280, and fluidly isolate the second portion 112 exiting the first condensing section 106A from the second portion 112 entering the first subcooler 108A. Moreover, the second common waterbox 275 may include a third baffle 286 (e.g., a partition forming a passage) configured to separate the first section 274 from the second section 278 of the second common waterbox 275, which fluidly isolates the second portion 112 flowing from the second subcooler 108B to the second condensing section 106B from the first portion 110 and/or the combined flow 124 flowing through the first section 274. Since both the first portion 110 and the second portion 112 of the cooling fluid 100 of FIG. 12 are directed from the cooling fluid supply 101 directly to the first condenser 102A and then to the second condenser 102B, the cooling fluid 100 may be considered to flow through the HVAC&R system 98 of FIG. 12 in a series flow arrangement.

Figure 13:
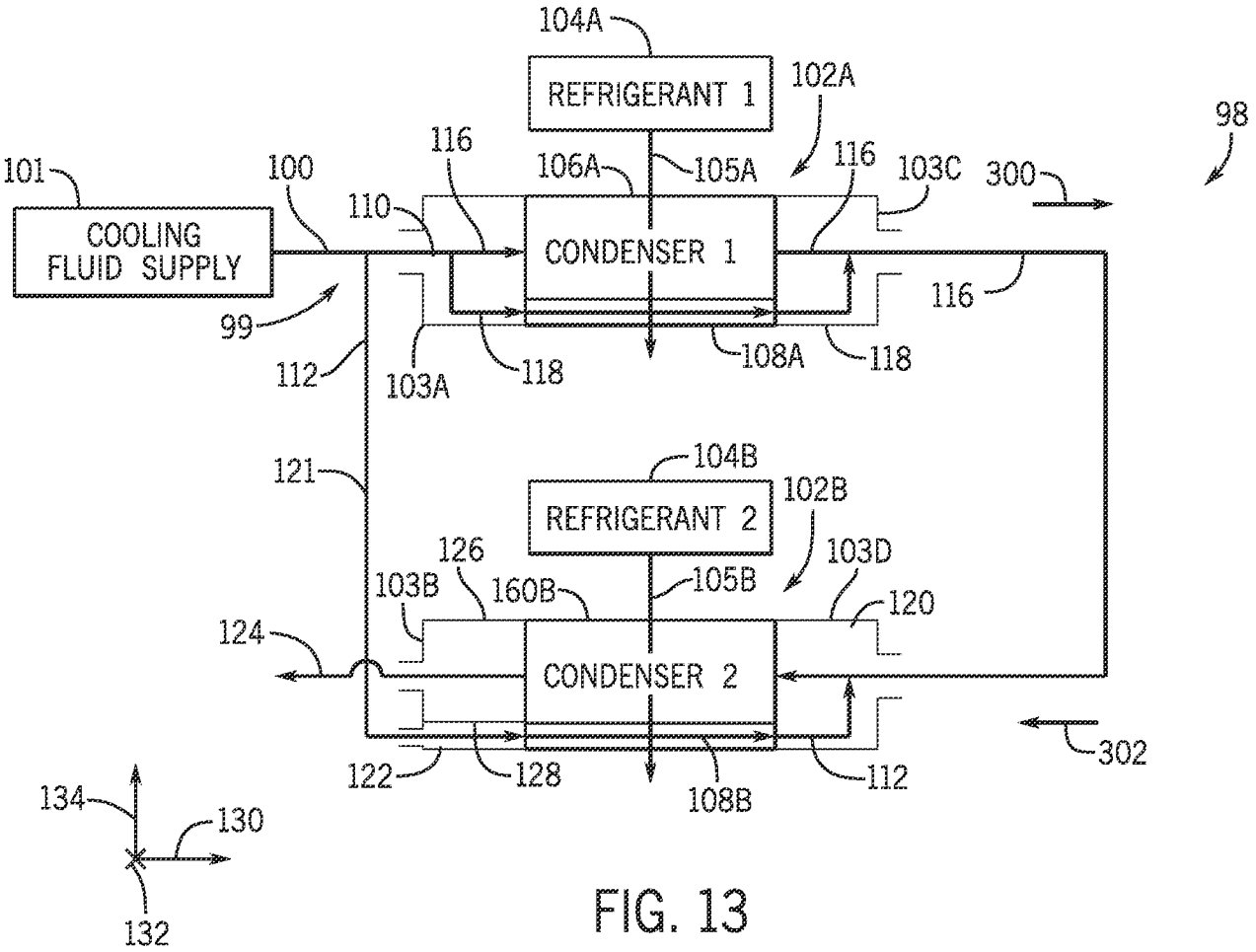
FIG. 13 is a plan view of an embodiment of the HVAC&R system having two condensers in a side by side arrangement, in accordance with an aspect of the present disclosure.

FIG. 13 is a plan view of an embodiment of the HVAC&R system 98 in which the two condensers 102 may be positioned adjacent to one another along the lateral axis 134 and in a side-by-side arrangement, rather than along the longitudinal axis 130 and in an end-to-end arrangement. In such orientation, the second condenser 102B may be positioned to facilitate direction of the cooling fluid 100 through the condensers 102. For example, the second waterbox 103B of the second condenser 102B may be positioned adjacent to the first waterbox 103A of the first condenser 102A. As a result, the conduit 121 may extend from the cooling fluid supply 101 to the second water box 103B without extending the entire combined lengths of the condensers 102, as shown in FIG. 5. Accordingly, the conduit 121 of FIG. 13 may be substantially shorter than the conduit 121 of FIG. 5.

Moreover, the third portion 116 of the cooling fluid 100 may flow out of the first condenser 102A in a first direction 300 along the longitudinal axis 130, and the third portion 116 may be directed to flow into the second condenser 102B in a second direction 302, opposite the first direction 300, along the longitudinal axis 130. Indeed, the third portion 116 of the cooling fluid 100 exits the first condenser 102A via the third water box 103C and enters the second condenser 102B via the fourth water box 103D, and the third and fourth water boxes 103C, 103D are positioned proximate one another in the side-by-side arrangement shown in FIG. 13. Thus, the combined flow 124 of the cooling fluid 100 may flow out of the second condenser 102B in a direction (e.g., the second direction 302) that is opposite the direction (e.g., the first direction 300) in which the cooling fluid 100 may flow into the first condenser 102A. Similar benefits and flow of the cooling fluid 100 may also be achieved in arrangements in which the condensers 102 are positioned adjacent to one another (e.g., in a side-by-side arrangement) along the vertical axis 132. That is, the conduit 121 may direct cooling fluid 100 to the second condenser 102B without extending along the entire combined lengths of the condensers 102, and the cooling fluid 100 may be directed out of the second condenser 102B in a direction opposite the direction in which the cooling fluid 100 is directed into the first condenser 102A. In any case, arranging the condensers 102 to be adjacent to one another side-by-side along the vertical axis 132 and/or the lateral axis 134 rather than end-to-end along the longitudinal axis 130 may reduce a space occupied by the HVAC&R system 98 and/or may reduce a cost associated with manufacturing the HVAC&R system 98 (e.g., by reducing a cost associated with purchasing or manufacturing the conduit 121).

Embodiments of the present disclosure are directed to an HVAC&R system having multiple vapor compression systems, in which each vapor compression system is configured to circulate a refrigerant. In some embodiments, a cooling fluid may be directed through condensers of each of the vapor compression systems to remove heat from the refrigerants of each of the vapor compression systems. Further, the refrigerants may each remove heat from a conditioning fluid directed through the vapor compression systems and configured to condition an environment. The HVAC&R system may be configured to operate to enable the cooling fluid to be directed to the condensers in a partial parallel flow arrangement, which may increase an overall amount of heat removed from the refrigerants when compared to a direct series arrangement. For example, the HVAC&R system may direct a first portion of cooling fluid from a cooling fluid supply through a first condensing section and/or a first subcooler of a first condenser and a second portion of the cooling fluid from the cooling fluid supply directly through a second subcooler of a second condenser. The first portion and the second portion may then combine and flow through a second condensing section of the second condenser to form the partial parallel flow arrangement. Accordingly, a performance, such as an efficiency, of the HVAC&R system may be improved.

While only certain features and embodiments of the disclosure have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described (i.e., those unrelated to the presently contemplated best mode of carrying out the disclosure, or those unrelated to enabling the claimed disclosure). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, air conditioning, and/or refrigeration (HVAC&R) system, comprising:

a first condenser configured to place a first refrigerant in a first heat exchange relationship with a cooling fluid;

a second condenser configured to place a second refrigerant in a second heat exchange relationship with the cooling fluid; and a conduit system configured to direct a first portion of the cooling fluid from a cooling fluid supply to the first condenser and then through a first section of the second condenser in a series configuration, wherein the conduit system is configured to direct a second portion of the cooling fluid directly from the cooling fluid supply to a second section of the second condenser, such that the first portion of the cooling fluid is directed through the first condenser in parallel with the second portion of the cooling fluid directed through the second section of the second condenser.

2. The HVAC&R system of claim 1, wherein the conduit system is not configured to direct the second portion to the first condenser.

3. The HVAC&R system of claim 1, wherein the first condenser and the second condenser are positioned in a side-by-side arrangement relative to one another.

4. The HVAC&R system of claim 3, wherein the conduit system is configured to direct the first portion of the cooling fluid from the first condenser to a condensing section of the second condenser, and wherein the first portion and the second portion of the cooling fluid are configured to combine into a combined flow prior to flowing through the condensing section of the second condenser.

5. The HVAC&R system of claim 4, wherein the second condenser comprises a first waterbox, a second waterbox, and a subcooler, wherein the second portion is configured to enter the subcooler via the first waterbox, and wherein the second portion and the first portion are configured to combine into the combined flow in the second waterbox.

6. The HVAC&R system of claim 5, wherein the first waterbox comprises a baffle configured to fluidly separate the second portion entering the subcooler from the combined flow exiting the condensing section.

7. The HVAC&R system of claim 1, comprising a valve configured to control a flow rate of the first portion into the first condenser and a flow rate of the second portion through the second section of the second condenser.

8. The HVAC&R system of claim 7, comprising a controller communicatively coupled to the valve, wherein the controller is configured to adjust a configuration of the valve based on received feedback indicative of an operating parameter of the HVAC&R system.

9. A heating, ventilation, air conditioning, and refrigeration (HVAC&R) system, comprising:

a first condenser comprising a first condensing section and a first subcooler, wherein the first condenser is configured to place a first refrigerant in a first heat exchange relationship with a cooling fluid;

a second condenser comprising a second condensing section and a second subcooler, wherein the second condenser is configured to place a second refrigerant in a second heat exchange relationship with the cooling fluid; and a conduit system configured to direct a first portion of the cooling fluid from a cooling fluid supply to the first condenser and then through the second condensing section of the second condenser in a series arrangement, wherein the conduit system is configured to direct a second portion of the cooling fluid from the cooling fluid supply directly to the second subcooler of the second condenser, such that the first portion of the cooling fluid is directed through the first condenser in parallel with the second portion of the cooling fluid directed through the second subcooler of the second condenser.

10. The HVAC&R system of claim 9, wherein the conduit system is configured to direct a first amount of the first portion of the cooling fluid to the first condensing section and a second amount of the first portion of the cooling fluid to the first subcooler.

11. The HVAC&R system of claim 10, wherein the conduit system is configured to direct the first portion of the cooling fluid from the first condensing section and the first subcooler to the second condensing section, and wherein the conduit system is configured to direct the second portion of the cooling fluid from the second subcooler to the second condensing section.

12. The HVAC&R system of claim 11, wherein the conduit system is configured to combine the first portion and the second portion into a combined flow prior to flowing through the second condensing section, such that the second refrigerant exchanges heat with the combined flow in the second condensing section.

13. The HVAC&R system of claim 9, comprising a valve having a first position and a second position, wherein the valve is configured to direct the second portion of the cooling fluid from the cooling fluid supply directly to the second subcooler in the first position, and the valve is configured to block the second portion of the cooling fluid from flowing from the cooling fluid supply directly to the second condenser in the second position.

14. The HVAC&R system of claim 13, comprising a controller communicatively coupled to the valve, wherein the controller is configured to adjust the valve between the first position and the second position based on received feedback.

15. The HVAC&R system of claim 14, wherein the received feedback comprises an operating parameter determined by a sensor of the HVAC&R system, a user input, or both.

16. The HVAC&R system of claim 13, wherein the HVAC&R system is configured to operate in a partial parallel flow arrangement and a series flow arrangement, wherein the valve is in the first position in the partial parallel flow arrangement, and wherein the valve is in the second position in the series flow arrangement.

17. A heating, ventilation, air conditioning, and refrigeration (HVAC&R) system, comprising:

a first condenser configured to place a first refrigerant in a first heat exchange relationship with a cooling fluid;

a second condenser comprising a condensing section and a subcooler, wherein the second condenser is configured to place a second refrigerant in a second heat exchange relationship with the cooling fluid; and a valve configured to:

regulate a flow of a first portion of the cooling fluid from a cooling fluid supply to the first condenser and the condensing section of the second condenser; and regulate a flow of a second portion from the cooling fluid supply directly to the subcooler of the second condenser, wherein the second condenser is disposed downstream of the first condenser relative to the flow of the first portion of the cooling fluid through the first condenser and the second condenser.

18. The HVAC&R system of claim 17, wherein the valve has a first position and a second position, wherein the valve is configured to direct the first portion of the cooling fluid from the cooling fluid supply to the first condenser and to direct the second portion of the cooling fluid from the cooling fluid supply directly to the second condenser in the first position, and wherein the valve is configured to direct the first portion and the second portion of the cooling fluid from the cooling fluid supply to the first condenser and to block the second portion of the cooling fluid from flowing from the cooling fluid supply directly to the second condenser in the second position.

19. The HVAC&R system of claim 18, comprising a controller communicatively coupled to the valve, wherein the controller is configured to adjust the valve between the first position and the second position based on received feedback from a sensor of the HVAC&R system, wherein the received feedback is indicative of an operating parameter of the HVAC&R system.

20. The HVAC&R system of claim 19, wherein the controller is configured to adjust the valve to the second position based on feedback indicative that operation of the first condenser, the second condenser, or both, is suspended or disabled.

* * * * *